US010248073B2

(12) United States Patent
Manabe

(10) Patent No.: US 10,248,073 B2
(45) Date of Patent: Apr. 2, 2019

(54) IMAGE FORMING APPARATUS AND SHEET CONVEYANCE APPARATUS

(71) Applicant: CANON KABUSHIKI KAISHA, Tokyo (JP)

(72) Inventor: Kenichi Manabe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/641,542

(22) Filed: Jul. 5, 2017

(65) Prior Publication Data

US 2018/0017932 A1 Jan. 18, 2018

(30) Foreign Application Priority Data

Jul. 12, 2016 (JP) ..... 2016-137496

(51) Int. Cl.
*G03G 15/00* (2006.01)
*G03G 21/16* (2006.01)

(52) U.S. Cl.
CPC ..... *G03G 21/1633* (2013.01); *G03G 15/6529* (2013.01); *G03G 21/1647* (2013.01); *G03G 2221/1654* (2013.01)

(58) Field of Classification Search
CPC ..... G03G 21/1633; G03G 21/1638; G03G 21/1647; G03G 15/6529; G03G 2221/1654
See application file for complete search history.

(56) References Cited

U.S. PATENT DOCUMENTS 5,017,961 A * 5/1991 Hasegawa ..... G03G 15/04 347/129
5,155,537 A * 10/1992 Komatsu ..... B65H 1/04 271/9.02
2003/0031480 A1* 2/2003 Miura ..... G03G 15/234 399/124
2005/0271400 A1* 12/2005 Okamoto ..... G03G 15/55 399/21
2014/0072333 A1* 3/2014 Yamashita ..... G03G 21/1623 399/110
2017/0336753 A1* 11/2017 Miyamoto ..... G03G 21/1633
2018/0017935 A1* 1/2018 Suzuki ..... G03G 21/1842

FOREIGN PATENT DOCUMENTS

JP 2000-147850 A 5/2000
JP 2013-095085 A 5/2013

* cited by examiner

*Primary Examiner* — Carla J Therrien
(74) *Attorney, Agent, or Firm* — Venable LLP

(57) ABSTRACT

The present disclosure provides an image forming apparatus capable of preventing members from colliding from each other upon an openable member being closed. An openable member opened and closed with respect to the apparatus body is locked in a closed state by a lock portion located at a lock position, and permitted to open upon the lock portion being moved to a release position. The apparatus body is provided with a movable portion that is moved to a first position if the openable member is opened and to a second position if the openable member is closed. The movable portion includes a block portion that is configured to block a movement of the lock portion from the release position to the lock position if the movable portion is located at the first position.

12 Claims, 10 Drawing Sheets

IMAGE FORMING APPARATUS AND SHEET CONVEYANCE APPARATUS

BACKGROUND OF THE INVENTION

Field of the Invention

The present invention relates to an image forming apparatus configured to form an image on a sheet and to output the sheet and a sheet conveyance apparatus configured to convey a sheet.

Description of the Related Art

Apparatuses configured to convey a sheet therein, such as an image forming apparatus including a copier and a printer, an option feeder, and a finisher, often include a cover member configured to be opened and closed with respect to an apparatus body to permit jam disposal. A plurality of such cover members may be disposed in the apparatus depending on an internal structure of the apparatus.

Japanese Patent Application Laid-open No. 2000-147850 discloses a copier including a front cover covering a front surface of the apparatus, a side cover covering a side surface of the apparatus, and a lock mechanism to lock the front cover. This copier includes a plurality of sensors disposed along a sheet conveyance path within the apparatus and is arranged such that a control portion can detect a position of a sheet when jamming occurs. Then, the control portion performs a control of switching locking and unlocking operations of the lock mechanism in response to a detection result of the sensor such that a user can open an appropriate cover and perform jam disposal to remove a jammed sheet.

By the way, the lock mechanism described in the above-described document is configured such that a lock actuator swings between a position (engage position) where the lock actuator is engaged with a stopper of the front cover and a position (release position) where the lock actuator is released from the stopper by a mechanism including a solenoid. However, in the lock mechanism constructed as described above, the lock actuator may move from the release position to the engage position after the front cover is opened. Such move may occur in a case when the solenoid is erroneously energized due to a surge current or the like or in a case when the lock actuator is rocked by vibration transmitted from an apparatus body. Then, if the front cover is closed in a state in which the lock actuator is located at a position near the engage position, there is a possibility that the lock actuator collides against the stopper, which may cause damage in the apparatus.

SUMMARY OF THE INVENTION

The present disclosure provides an image forming apparatus and a sheet conveyance apparatus capable of preventing members from colliding from each other when an openable member is closed.

According to one aspect of the present invention, an image forming apparatus includes an apparatus body including an image forming portion configured to form an image on a sheet, an openable member configured to be opened and closed with respect to the apparatus body a lock portion disposed in the apparatus body and movable between a lock position to lock the openable member in a closed state and a release position to permit opening and closing of the openable member, and a movable portion disposed in the apparatus body and configured to move along with opening and closing of the openable member such that the movable portion is located at a first position if the openable member is opened and at a second position if the openable member is closed. The movable portion includes a block portion that is configured to block a movement of the lock portion from the release position to the lock position if the movable portion is located at the first position and that permits the lock portion to move from the release position to the lock position if the movable portion is located at the second position.

According to another aspect of the present invention, a sheet conveyance apparatus includes an apparatus body, a conveyance unit supported by the apparatus body and configured to convey a sheet, an openable member configured to be opened and closed with respect to the apparatus body, a lock portion disposed in the apparatus body and movable between a lock position to lock the openable member in a closed state and a release position to permit opening and closing of the openable member, and a movable portion disposed in the apparatus body and configured to move along with opening and closing of the openable member such that the movable portion is located at a first position if the openable member is opened and at a second position if the openable member is closed. The movable portion includes a block portion that is configured to block a movement of the lock portion from the release position to the lock position if the movable portion is located at the first position and that permits the lock portion to move from the release position to the lock position if the movable portion is located at the second position.

Further features of the present invention will become apparent from the following description of exemplary embodiments with reference to the attached drawings.

DESCRIPTION OF THE EMBODIMENTS

An image forming apparatus and a sheet conveyance apparatus of the present disclosure will be described below with reference to the drawings.

First Embodiment

Figure 1:
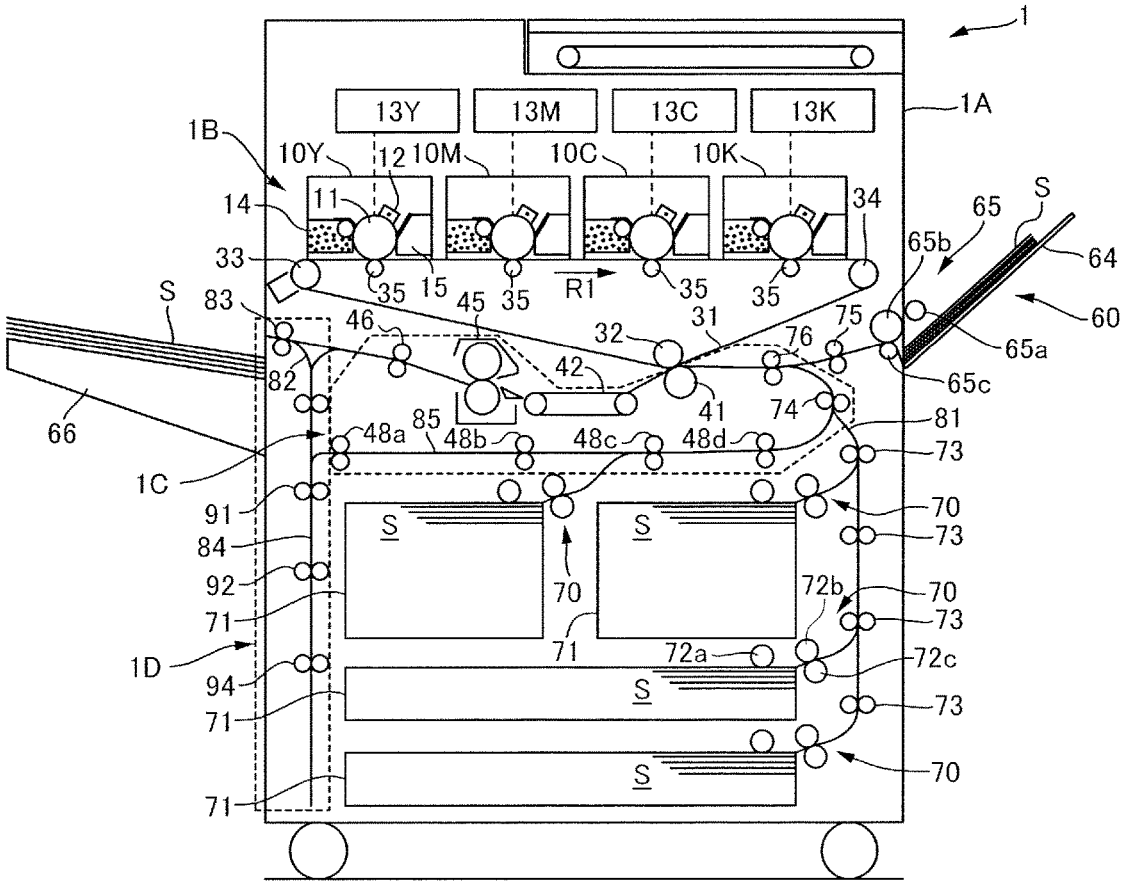
FIG. 1 is a schematic diagram illustrating a configuration of an image forming apparatus.

As illustrated in FIG. 1, the image forming apparatus 1 is a multi-function printer including an electrophotographic image forming portion 1B within an apparatus body 1A. The image forming apparatus 1 is configured to form an image on a sheet S based on image information inputted from an external personal computer or image information read from a document. Here, the sheet S refers to a thin recording medium such as a sheet of paper and an envelope, a plastic film such as a sheet for an overhead projector (OHP), and a cloth.

The image forming portion 1B, i.e., one exemplary image forming portion, takes a tandem intermediate transfer type configuration including four image forming units 10Y, 10M, 10C and 10K configured to form toner images of four colors of yellow, magenta, cyan and black and an intermediate transfer belt 31. The image forming units 10Y, 10M, 10C and 10K are electrophotographic units each including a photosensitive drum 11 composed of a photoconductor and each of exposure units 13Y, 13M, 13C and 13K configured to irradiate the photosensitive drum 11 with a laser beam. Because the configuration of the respective image forming units 10Y, 10M, 10C and 10K are approximately same except of the colors of the toners used in development, the following description will be made by exemplifying the yellow image forming unit 10Y.

The image forming unit 10Y includes an electrifier 12, a developer 14, and a cleaner 15, and these components are disposed around the photosensitive drum 11. In response to a start of an image forming operation, the electrifier 12 homogeneously electrifies a surface of the photosensitive drum 11 as the photosensitive drum 11 rotates. The exposure unit 13Y scans the surface of the photosensitive drum 11 based on the image information and forms an electrostatic latent image corresponding to a color separation image of yellow. The developer 14 visualizes, i.e., develops, the electrostatic latent image into a toner image by supplying electrified toner to the photosensitive drum 11.

The intermediate transfer belt 31 serving as an intermediate transfer body is an endless belt formed of film and is stretched around a driving roller 33, a tension roller 34 and a secondary transfer inner roller 32. The intermediate transfer belt 31 is rotationally driven by the driving roller 33 in a direction following a rotation of the photosensitive drum 11, i.e., in a direction of an arrow R1 in FIG. 1. Disposed on an inner circumferential side of the intermediate transfer belt 31 at a position facing the photosensitive drum 11 of each image forming unit are primary transfer rollers 35. The toner images formed in the respective image forming units 10Y, 10M, 10C, and 10K are primarily transferred onto the intermediate transfer belt 31 such that the toner images are superimposed with each other by the primary transfer roller 35 to which bias voltage is applied.

Disposed on an outer circumferential side of the intermediate transfer belt 31 is a secondary transfer roller 41 facing the secondary transfer inner roller 32 with the intermediate transfer belt 31 between the secondary transfer inner roller 32 and the secondary transfer roller 41. The secondary transfer roller 41 is one example of a transfer device that transfers the toner image onto a sheet, and composes a secondary transfer portion including a nip portion between the intermediate transfer belt 31 and the secondary transfer roller 41. The full-color toner image borne on the intermediate transfer belt 31 is secondarily and collectively transferred onto the sheet S at the secondary transfer portion by the secondary transfer roller 41 to which bias voltage is applied.

In parallel with such image forming operation, the sheet S is fed toward the image forming portion 1B from one of a plurality of sheet feed cassettes 71 provided at a lower part of the apparatus body 1A or from a manual sheet feed portion 60 provided at a side part of the apparatus body 1A. The sheet S stored in each sheet feed cassette 71 is delivered out, being separated one by one, by a feed unit 70 including a pickup roller 72*a*, a feed roller 72*b* and a retard roller 72*c*. The sheet S delivered out of the sheet feed cassette 71 is conveyed to a registration roller pair 76 through 73 and a pre-registration conveyance roller pair 74. It is noted that the sheet delivered out of the upper left sheet feed cassette 71 in FIG. 1 is conveyed through a part of a duplex conveyance path 85. Meanwhile, the sheet S placed on a tray 64 of the manual sheet feed portion 60 is conveyed toward the registration roller pair 76, being separated one by one, by a feed unit 65 including a pickup roller 65*a*, a feed roller 65*b* and a retard roller 65*c*.

The registration roller pair 76 corrects a skew of the sheet S and conveys the sheet S toward the secondary transfer portion while synchronizing with progress of the image forming operation of the image forming portion 1B. The sheet S onto which the toner image has been transferred at the secondary transfer portion is conveyed through a pre-fixing conveyance portion 42 to a fixing unit 45 including a roller pair configured to nip and convey the sheet S and a heat source not illustrated. The fixing unit 45 fixes the toner image onto the sheet S by heating and pressing the sheet S. The sheet S which has passed through the fixing unit 45 is conveyed by an inner discharge roller pair 46 toward a branch portion 82.

In a case of simplex printing, the sheet S is guided to a discharge roller pair 83 by a switching member not illustrated at the branch portion 82 and is discharged by the branch portion 82 onto a discharge tray 66 outside of the apparatus. In a case of duplex printing, the sheet S which has passed through the fixing unit 45 is guided by the branch portion 82 to a reverse conveyance portion 1D. The reverse conveyance portion 1D includes a plurality of sets of normally and reversely rotatable roller pairs 91, 92 and 94 and switches back the sheet S guided to a reverse path 84 to send to the duplex conveyance path 85. The duplex conveyance path 85 includes a plurality of sets of roller pairs 48*a*, 48*b*, 48*c* and 48*d* along the path and conveys the sheet S toward the registration roller pair 76. Then, the sheet S on which an image has been formed on a second surface thereof through the same process with the first surface is guided to the discharge roller pair 83 at the branch portion 82 and is discharged onto the discharge tray 66.

Sheet Conveyance Unit

Figure 2A:
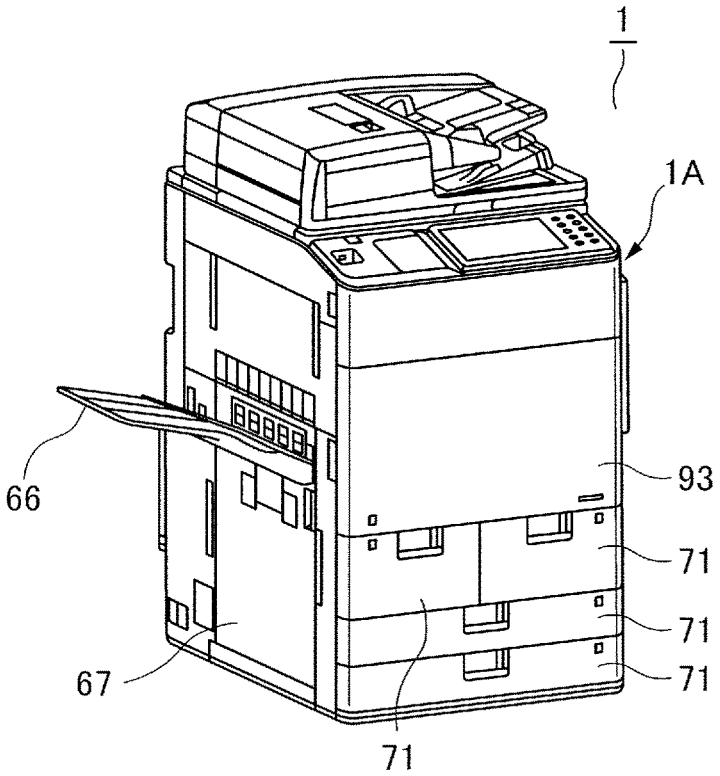
FIG. 2A is a perspective view of the image forming apparatus.
Figure 2B:
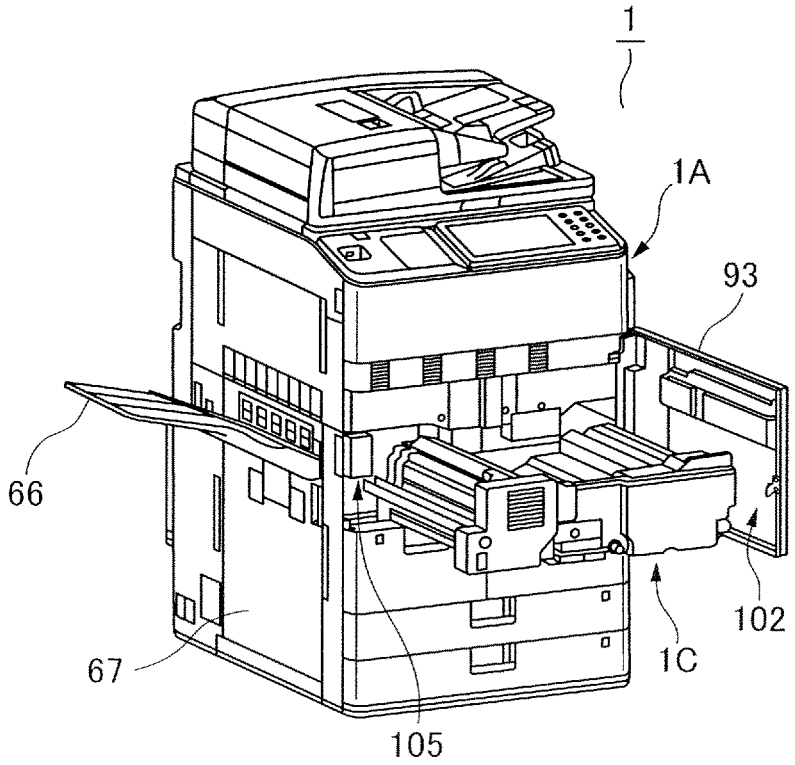
FIG. 2B is a perspective view of the image forming apparatus in a state in which a sheet conveyance unit is drawn out.

Next, a configuration for providing an access to an internal structure of the image forming apparatus 1 will be described. As illustrated in FIGS. 2A and 2B, a front door 93 covering the front surface of the image forming apparatus 1 can be opened and closed with respect to the apparatus body 1A. The front door 93 is supported turnably by the apparatus body 1A centering on a hinge portion 93*a* provided at a right end portion, and is opened by drawing a left end portion 93*b* of the front door 93 to the front side (see FIG. 3A).

As illustrated in FIG. 2B, in a condition in which the front door 93 is opened, the sheet conveyance unit 1C can be pulled out of the apparatus body 1A to the front side. Here, the sheet conveyance unit 1C is a unit including conveyance members configured to convey the sheet S within the apparatus body 1A, such as rollers and a belt, and guide members configured to guide the sheet S within the apparatus body 1A. Components of the sheet conveyance unit 1C of the present embodiment are indicated by a broken line in FIG. 1, and are supported by a support frame drawably attached to the apparatus body 1A. That is, the pre-registration conveyance roller pair 74, the registration roller pair 76, the secondary transfer roller 41, the pre-fixing conveyance portion 42, the fixing unit 45, the inner discharge roller pair 46, and the conveyance roller pairs 48*a*, 48*b*, 48*c*, and 48*d* for the duplex conveyance are included in the sheet conveyance unit 1C.

It is noted that as illustrated in FIG. 2A, a side cover 67 configured to be opened and closed in a right/left direction of the apparatus body 1A is disposed on a side surface of the apparatus body 1A. The side cover covers a reversing path 84 of the reverse conveyance portion 1D (see FIG. 1), and it is possible to access an inside of the reverse conveyance portion 1D if the side cover 67 is opened.

Lock Unit

Figure 3A:
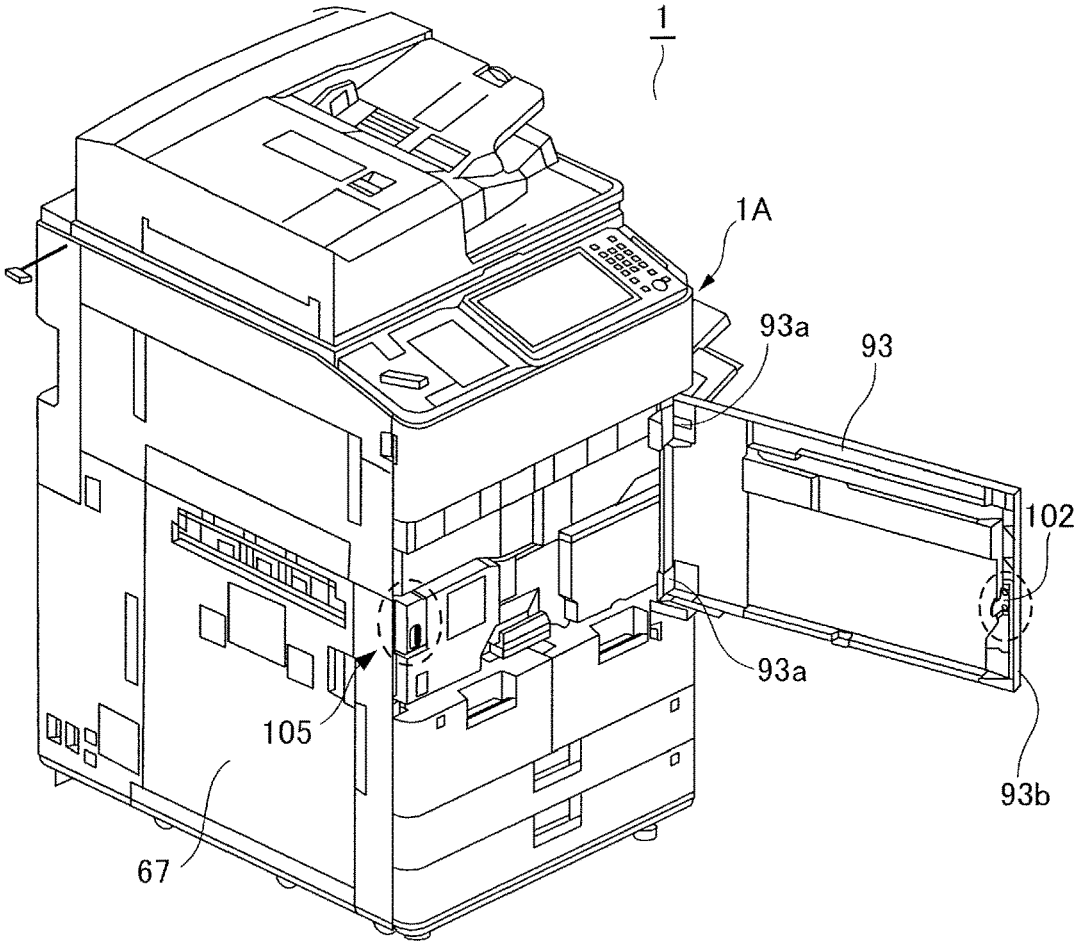
FIG. 3A is a perspective view of the image forming apparatus in a state in which a front door is opened.
Figure 3B:
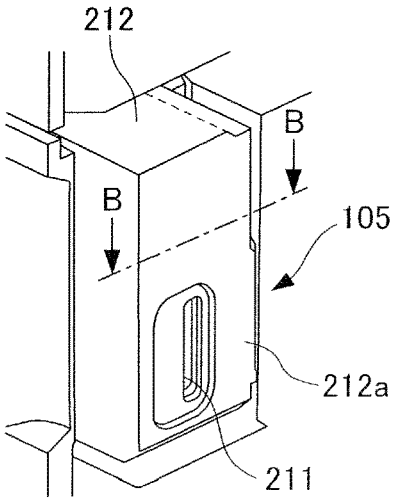
FIG. 3B is an enlarged view of a lock unit.
Figure 3C:
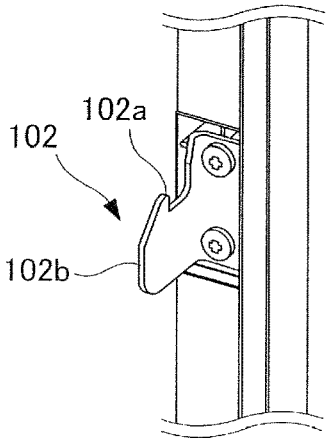
FIG. 3C is an enlarged view of a hook portion.

Next, a lock mechanism capable of locking the front door 93 in the closed condition will be described. As illustrated in FIG. 3A, the front door 93 is provided with a hook portion 102, while a lock unit 105 to lock the hook portion 102 is attached to the apparatus body 1A. As illustrated in FIG. 3B, the lock unit 105 is covered by a cover member 212 fixed to the apparatus body 1A. The cover member 212 is an approximately cuboid case, and an opening portion 211 through which the hook portion 102 is inserted is formed in a front portion 212*a* of the cover member 212. Meanwhile, as illustrated in FIG. 3*c*, the hook portion 102 is formed into a shape of a hook having a locked portion 102*a* to be locked by the lock unit 105 and a distal end portion 102*b* projecting toward the apparatus body 1A from the front door 93.

Figure 4A:
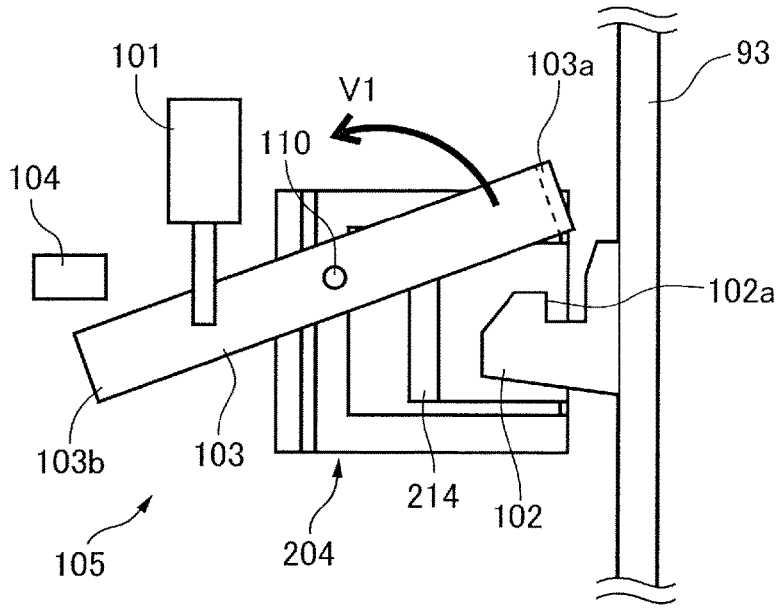
FIG. 4A is a schematic diagram of the lock unit of a first embodiment in a case where a lock member is located at a release position.

As illustrated in FIG. 4A, the lock unit 105 includes a lock member 103, a solenoid 101 and a lock detection sensor 104. The lock member 103, which is one example of a lock portion, includes a distal end portion 103*a* configured to abut with and to retain the locked portion 102*a* of the hook portion 102. The lock member 103 is a swing member swingable centering on a support shaft 110 and is configured such that the distal end portion 103*a* thereof turns toward a release position if the solenoid 101 is turned OFF (see FIG. 4A), while being separated from the hook portion 102, i.e., in a direction of an arrow V1 in FIG. 4A, by its own weight.

The solenoid 101 serving as a driving portion is connected with the lock member 103 on a side opposite from the distal end portion 103*a* of the lock member 103 across the support shaft 110. If the solenoid 101 is turned ON, i.e., in a state illustrated in FIG. 4B, the lock member 103 is attracted by the solenoid 101 and turns in a direction indicated by an arrow V2. Then, the distal end portion 103*a* engages with the locked portion 102*a* of the hook portion 102 and retains the hook portion 102 at a lock position where the hook portion 102 is locked.

The lock detection sensor 104 serving as a lock detection portion is a sensor member whose object of detection is a detection target portion 103*b*, which is another end of the lock member 103 opposite from the distal end portion 103*a*. A through-beam photoelectric sensor or a contact type pressure sensor may be used for the lock detection sensor 104, for example. According to the present embodiment, the lock detection sensor 104 detects the detection target portion 103*b* and is turned ON in the case when the lock member 103 is located at the lock position (see FIG. 4B), and the lock detection sensor 104 is turned OFF in the case when the lock member 103 is located at the release position (see FIG. 4A).

Lock Operation

The lock unit 105 constructed as described above performs lock and unlock operations of the front door 93 according to a control signal transmitted from a control circuit mounted in the apparatus body 1A. Sensors capable of detecting a jam of the sheet S are disposed along a route through which the sheet S fed from the sheet feed cassette 71 or the manual sheet feed portion 60 is conveyed and discharged onto the discharge tray 66 within the apparatus body 1A. In a case when a jam occurs, an operator can remove the sheet S within the apparatus by opening the front door 93 and drawing out the sheet conveyance unit 1C for example (see FIG. 2B).

However, in a case when a jam occurs at a specific position on a conveyance path, it is preferable to avoid the operation of drawing out the sheet conveyance unit 1C. For instance, if the sheet conveyance unit 1C is drawn out in a state in which the sheet S is located at a position across the sheet conveyance unit 1C and the reverse conveyance portion 1D, not only the sheet S may be torn, but also the apparatus may be damaged (see FIG. 1).

Then, the present embodiment is arranged such that a control is made such that even if a jam occurs, the lock unit 105 locks the front door 93 in a case when there is a possibility that the sheet S exists at a boundary position of the sheet conveyance unit 1C. That is, in such a case, power is fed to the solenoid 101 such that the hook portion 102 is locked by the lock member 103. This arrangement makes it possible to prevent a user from carelessly opening the front door 93 and drawing out the sheet conveyance unit 1C and to prevent the apparatus from being damaged.

It is noted that the case in which the jam of the sheet S occurs at the specific position has been exemplified above as the case when the lock unit 105 locks the front door 93, and switching of the locking/unlocking operation of the lock unit 105 may be appropriately set depending on functions and uses of the image forming apparatus 1. For instance, it is conceivable to set such that the front door 93 is locked during at least a period in which the image forming portion 1B executes an image forming operation.

Opening/Closing Detecting Configuration

Figure 5A:
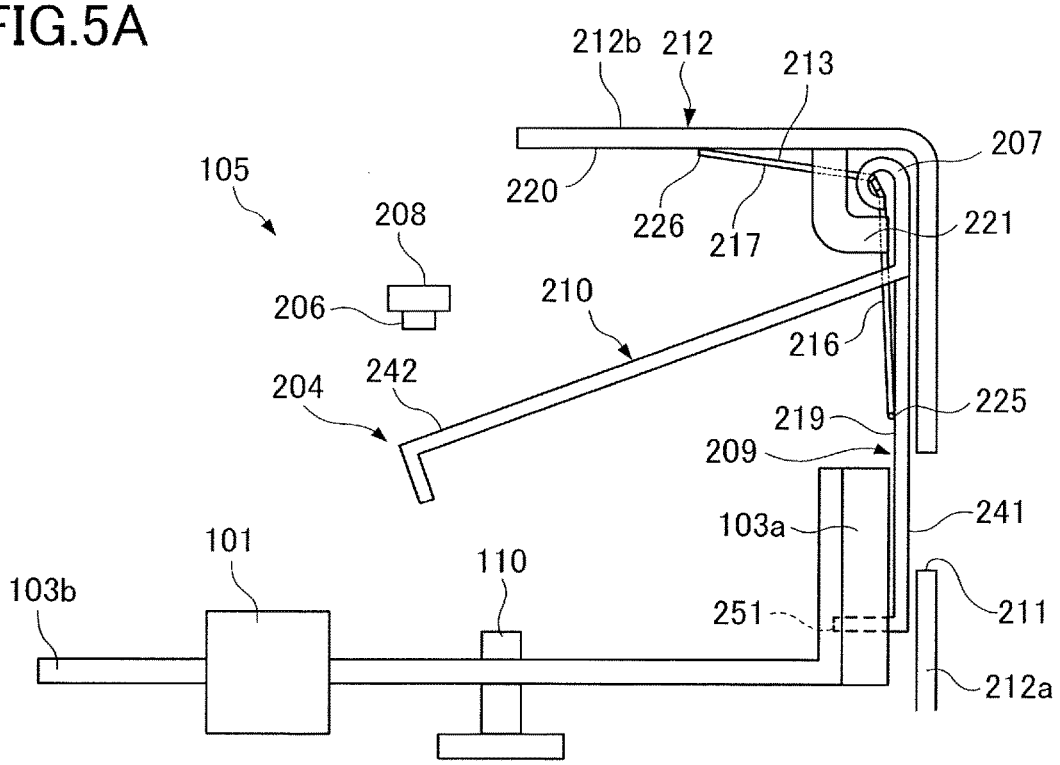
FIG. 5A is a section view of the lock unit in the state in which the front door is opened.
Figure 5B:
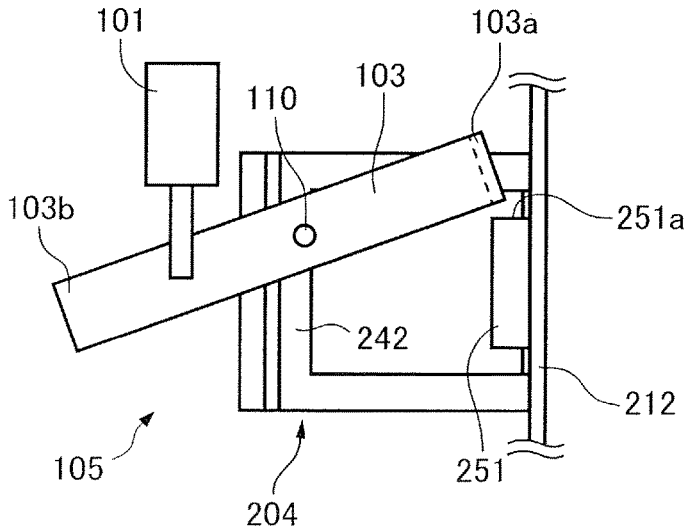
FIG. 5B is a schematic diagram illustrating a positional relationship between the lock member and an opening/closing detection lever.

As illustrated in FIG. 5A, the lock unit 105 is provided with a configuration for detecting opening/closing of the front door 93 including an opening/closing detection lever 204, an opening/closing detection sensor 208, and an urge portion 213. FIG. 5B is a section view of the lock unit 105 taken along a line B-B indicated in FIG. 3B.

The opening/closing detection sensor 208 is a contact-type pressure sensor, i.e., contact switch to detect a contact of an object, including a press portion 206 to which the opening/closing detection lever 204 abuts. The opening/closing detection sensor 208 is one example of a detection sensor, and a detection sensor using another detection method such as a through beam photoelectric sensor may be used. The opening/closing detection lever 204 serving as a movable portion includes a detection target portion 242 abuttable with the press portion 206 of the opening/closing detection sensor 208 and an abutment portion 241 serving as an abutment surface to which the hook portion 102 comes into contact, and is turnably supported by a support portion 221 of the cover member 212.

Figure 6:
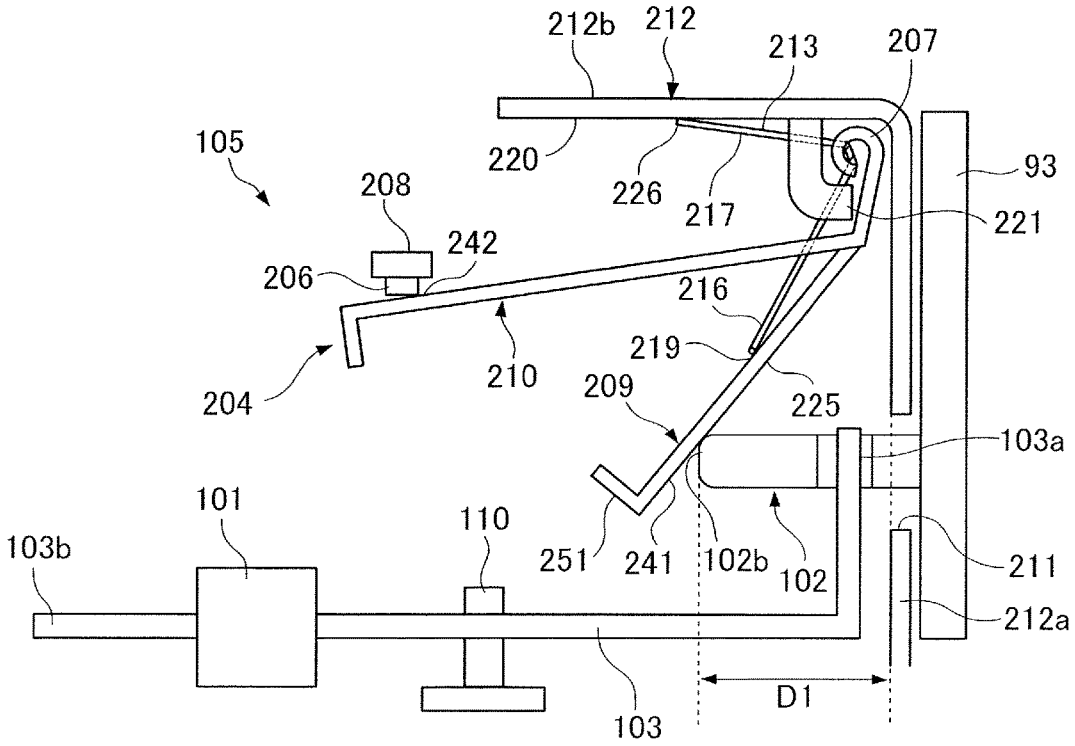
FIG. 6 is a section view of the lock unit in a state in which the front door is closed.

As illustrated in FIGS. 5A and 6, the opening/closing detection lever 204 is movable between a first position, as illustrated in FIG. 5A, in which the detection target portion 242 is separated from the press portion 206, and a second position, as illustrated in FIG. 6, in which the detection target portion 242 presses the press portion 206. The urge portion 213 is a spring member interposed between the cover member 212 of the lock unit 105 and the opening/closing detection lever 204 and urges the opening/closing detection lever 204 toward the first position.

Figure 7:
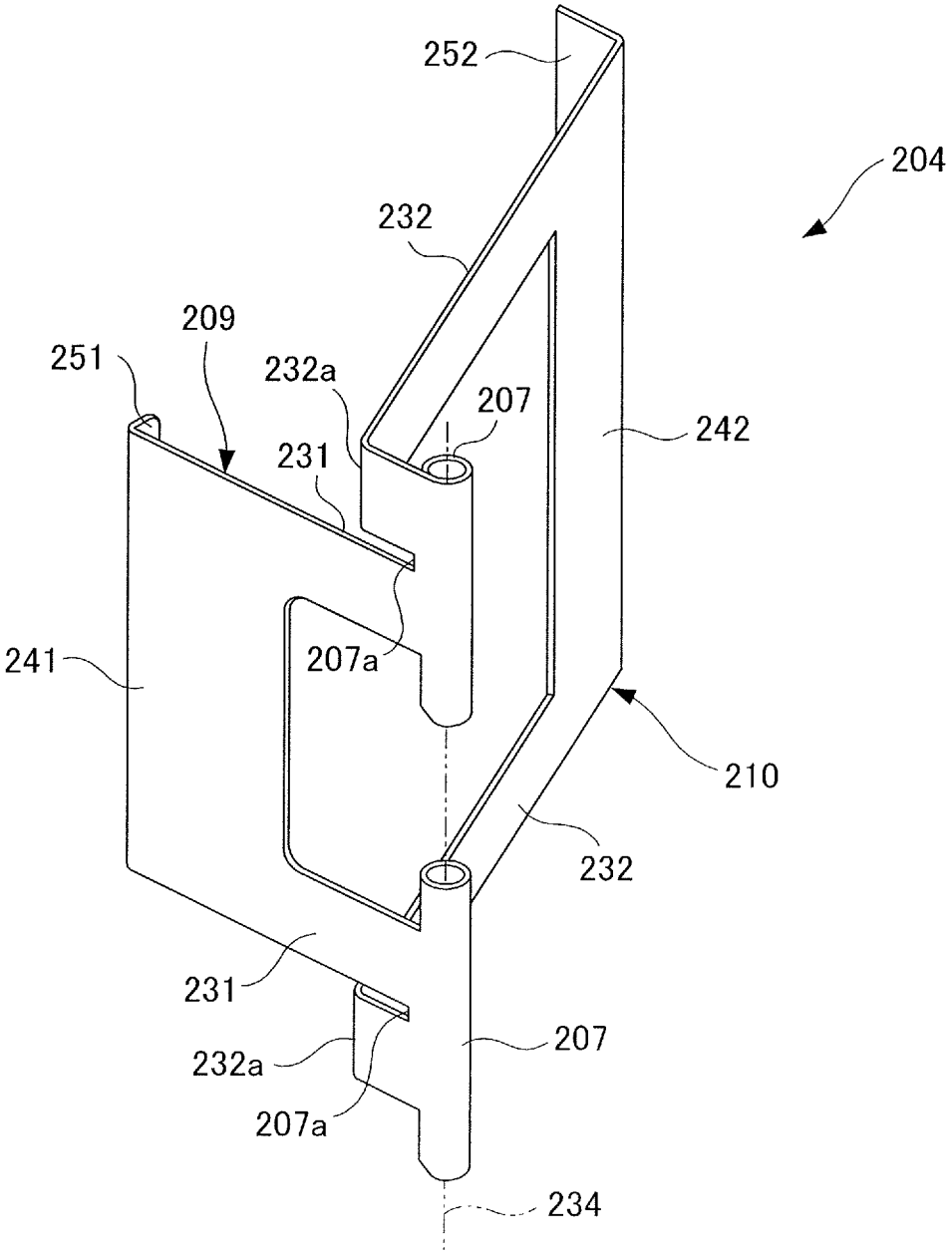
FIG. 7 is a perspective view of the opening/closing detection lever.

The configuration of the opening/closing detection lever 204 and the urge portion 213 will be described in detail. The opening/closing detection lever 204 is formed of an elastic material such as stainless steel for spring and, as illustrated in FIG. 7, includes a first branched portion 209 including the abutment portion 241 and a second branched portion 210 including the detection target portion 242. A shaft portion 207 is formed into a cylindrical shape for example such that the opening/closing detection lever 204 is turnable centering on an axial line 234, i.e., a rotation axis of the opening/closing detection lever 204. Thus, the shaft portion 207 is held turnably by the support portion 221 of the cover member 212 (see FIG. 5A), while a move of the shaft portion 207 in a direction along the axial line 234 is restricted.

The first branched portion 209 is composed of the abutment portion 241 and two arm portions 231 and 231 extending radially from the shaft portion 207 and supporting the abutment portion 241. The second branched portion 210 is composed of the detection target portion 242 and two arm portions 232 and 232 extending radially from the shaft portion 207 and supporting the detection target portion 242. First and second bent portions 251 and 252 bent approximately at right angles with respect to the abutment portion 241 and the detection target portion 242, respectively, are provided at distal ends of the first and second branched portions 209 and 210.

The arm portions 231 and 232 of these first and second branched portions 209 and 210 are formed so as to be branched from their bases at a branch portion 207*a* located at an outer circumferential part of the shaft portion 207. Still further, while the arm portion 231 of the first branched portion 209 is formed straightly, the arm portion 232 of the second branched portion 210 is provided with a bent portion 232*a*. Due to that, the abutment portion 241 and the detection target portion 242 are disposed at different circumferential positions with respect to the shaft portion 207. Preferably, the opening/closing detecting lever 204 described above is formed of a single plate member by press working including punching and bending processes for example.

Figure 8:
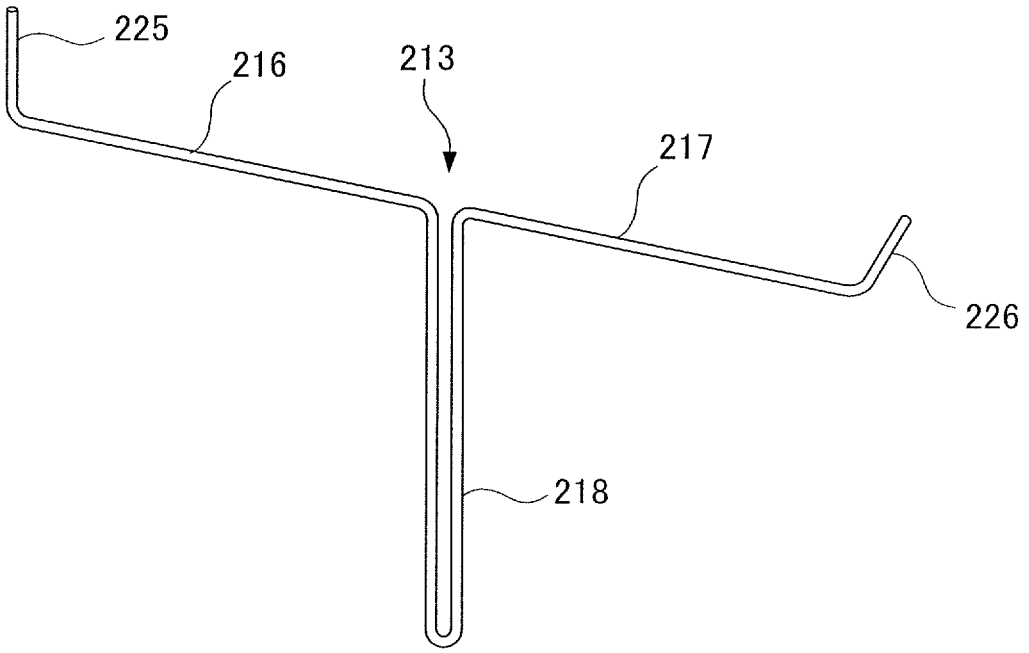
FIG. 8 is a perspective view of an urge portion.

As illustrated in FIG. 8, the urge portion 213 is a linear spring member formed of a plated steel wire or the like. This spring member is formed approximately into a shape of "T" by first and second arm portions 216 and 217 and a U-shaped arm connecting portion 218 configured to connect these arm portions. The respective arm portions 216 and 217 are provided, at distal end portions thereof, with first and second bent portions 225 and 226 formed so as to bend approximately at right angles with respect to the corresponding arm portions 216 and 217. Among these bent portions, while the first bent portion 225 extends in a direction approximately in parallel with the arm connecting portion 218, the second bent portion 226 extends in a direction vertical to a plane formed by axial lines of the arm connecting portion 218 and the second arm portion 217.

Figure 9:
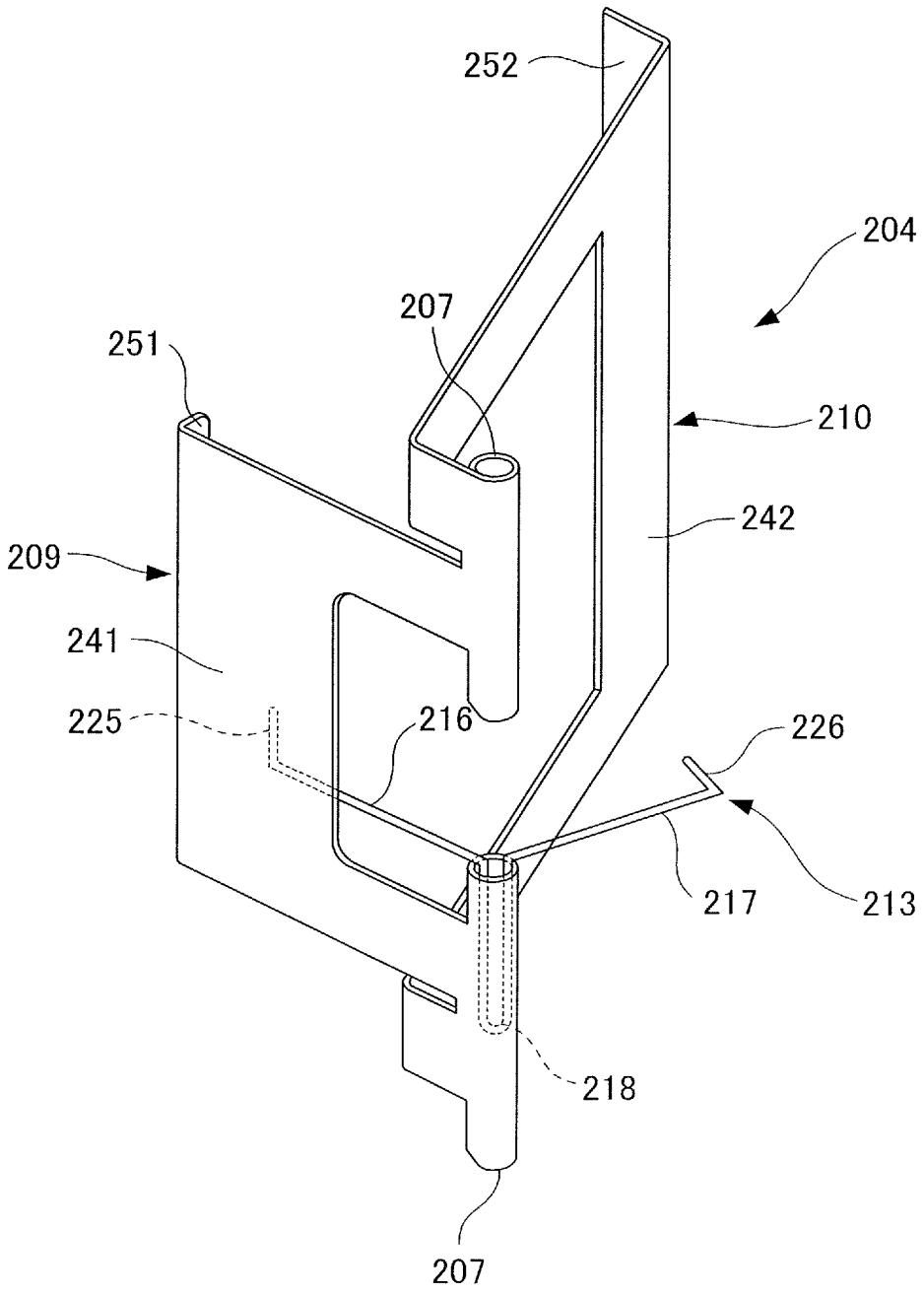
FIG. 9 is a perspective view of the opening/closing detection lever to which the urge portion is assembled.

As illustrated in FIG. 9, the urge portion 213 is held by the opening/closing detection lever 204 by fitting the arm connecting portion 218 into the lower shaft portion 207 of the opening/closing detection lever 204. Then, as illustrated in FIG. 5A, the opening/closing detection lever 204 is assembled to the lock unit 105 such that the abutment portion 241 faces the opening portion 211 of the cover member 212 and such that the detection target portion 242 faces the opening/closing detection sensor 208, i.e., in a state in which a hole defined by the opening portion 211 can be covered by the abutment portion 241.

An operation of the lock unit 105 constructed as described above and carried out along with an opening/closing operation of the front door 93 will be described. Here, the description will be made by assuming that the opening/closing operation of the front door 93 is carried out in the state in which the lock member 103 is located at the release position.

As illustrated in FIG. 5A, the urge portion 213 is sandwiched and bent by the cover member 212 and the opening/closing detection lever 204 in a state in which the opening/closing detection lever 204 is assembled to the lock unit 105. That is, while the first arm portion 216 and the first bent portion 225 are pressed by a pressed surface 219 of the abutment portion 241 of the opening/closing detection lever 204, the second arm portion 217 is pressed by an inner surface 220 of the side portion 212*b* of the cover member 212. Thereby, the first and second arm portions 216 and 217 which are aligned approximately on one straight line in a natural state are compressed to an angle close to the right angle.

Due to that, if the front door 93 is opened and the hook portion 102 is separated from the opening/closing detection lever 204 (see FIG. 5A), the first branched portion 209 is pressed against a front portion 212*a* of the cover member 212 by a resilient force of the urge portion 213. Thereby, the opening/closing detection lever 204 is held at a first position, i.e., a position in an open state. Because the detection target portion 242 of the opening/closing detection lever 204 separates from the opening/closing detection sensor 208, the opening/closing detection sensor 208 is turned OFF.

Meanwhile, when the front door 93 is closed, the hook portion 102 enters the lock unit 105 through the opening portion 211 of the cover member 212 and the distal end portion 102*b* of the hook portion 102 abuts against the abutment portion 241 of the opening/closing detection lever 204 as illustrated in FIG. 6. Because the abutment portion 241 is pressed by the hook portion 102, the entire opening/closing detecting lever 204 turns to an inside of the apparatus, i.e., a left side in FIG. 6, and moves to the second position, i.e., a position in a close state. In this case, the detection target portion 242 presses the press portion 206 of the opening/closing detection sensor 208, so that the opening/closing detection sensor 208 turns ON.

By the way, an insertion amount D1 of the hook portion 102 when the front door 93 is closed is set to be longer than a length corresponding to a turning angle that causes the detection target portion 242 of the opening/closing detection lever 204 to come into contact with the press portion 206 of the opening/closing detection sensor 208. Accordingly, while the first branched portion 209 of the opening/closing detection lever 204 reaches an angle corresponding to the insertion amount D1 by being pressed by the hook portion 102, the opening/closing detection sensor 208 restricts turning of the second branched portion 210 in a stage in which the second branched portion 210 reaches a predetermined angle smaller than that of the first branched portion 209.

Because the opening/closing detection lever 204 is made of the elastic material in the present embodiment, a difference of the turning angles of the first and second branched portions 209 and 210 is absorbed by elastic deformation of the opening/closing detection lever 204. That is, the insertion amount D1 of the hook portion 102 is set large enough to actuate the opening/closing detection sensor 208 stably, and an impact generated when the front door 93 is closed is reduced by elasticity of the opening/closing detection lever 204. This arrangement makes it possible to reduce a force of the opening/closing detection lever 204 pressing the opening/closing detection sensor 208 and to reduce a possibility that the components are deformed or damaged when the front door 93 is closed. Note that it is more preferable to set a turning range of the opening/closing detection lever 204 by a support portion 221 so that the detection target portion 242 of the opening/closing detection lever 204 does not move beyond the position of the opening/closing detection sensor 208 as illustrated in FIG. 6.

Positional Relationship Between Lock Member and Opening/Closing Detecting Lever

By the way, in the configuration in which the lock member 103 is moved by the driving portion, it is conceivable that the lock member 103 moves toward the lock portion by some reason in the state in which the front door 93 is opened. For instance, in the case where the solenoid 101 is used to move the lock member 103 from the release position to the lock position like the present embodiment, the lock member 103 may be driven toward the lock position if electric power is erroneously fed to the solenoid 101. It is also conceivable that the lock member 103 is rocked and moves toward the lock position in a case when vibration is applied to the apparatus body 1A. If the front door 93 is closed in a state in which the lock member 103 comes close to the lock position by such circumstance, the hook portion 102 may collide against the lock member 103, thus possibly causing deformation and damage of the components.

Based on insights described above, the present embodiment realizes a configuration in which the lock member 103 is kept at the release position if the front door 93 is opened by using the opening/closing detection lever 204, which turns along with the opening/closing motion of the front door 93 and whose move in the direction along the turning axial line is restrained. That is, as illustrated in FIG. 5B, if the opening/closing detection lever 204 is located at the first position and the lock member 103 is located at the release position, the distal end portion 103*a* of the lock member 103 is disposed so as to locate above the first bent portion 251 of the opening/closing detection lever 204. In this state, the distal end portion 103*a* is configured to overlap at least partially with the first bent portion 251 when viewed from above as illustrated in FIG. 5A.

By constructing the lock unit 105 as described above, movement of the lock member 103 is restricted by the opening/closing detection lever 204 in the case when the front door 93 is unlocked and the front door 93 is switched from the close state to the open state. Accordingly, even if the solenoid 101 makes an abnormal action or the lock member 103 is rocked, the distal end portion 103*a* of the lock member 103 is received by an upper end portion 251*a* of the first bent portion 251 and the move of the lock member 103 toward the lock position is blocked. That is, according to the present embodiment, the upper end portion 251*a* of the first bent portion 251 functions as the block portion to restrict a swing range of the lock portion when the openable member is opened. This arrangement makes it possible to prevent the apparatus from being damaged by the collision of the hook portion 102 and the lock member 103. Further, because such block portion is provided in a member for detecting the opening/closing motion of the openable member, i.e., the opening/closing detection lever 204, it is not required to dispose an additional member for restricting swinging of the lock member 103 and it is possible to construct the apparatus in compact. It is noted that as illustrated in FIGS. 4A and 4B, the upper end portion 251*a* separates from the distal end portion 103*a* of the lock member 103 and permits the lock member 103 to move to the lock position when the opening/closing detection lever 204 is pressed by the hook portion 102.

Figure 4B:
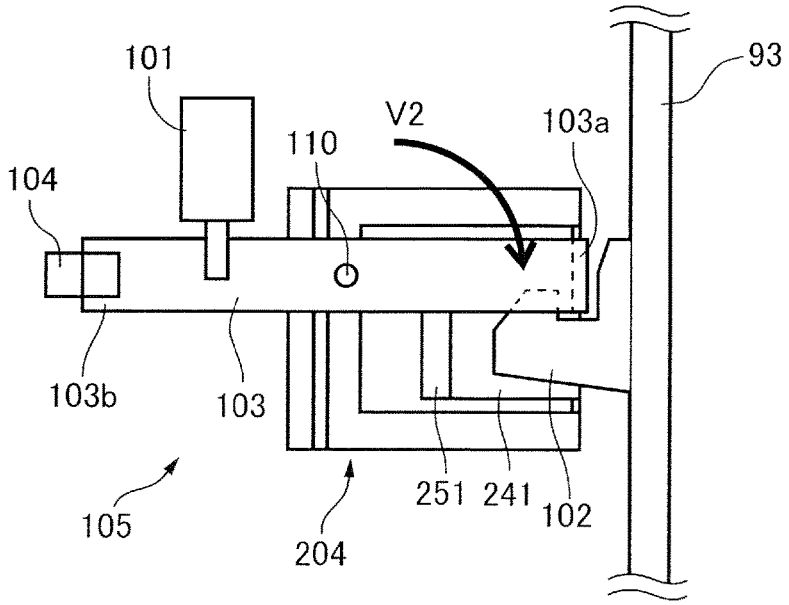
FIG. 4B is a schematic diagram of the lock unit of a first embodiment in a case where the lock member is located at a lock position.

As illustrated in FIGS. 4B and 5B, preferably, the upper end portion 251*a* of the first bent portion 251 is disposed above an upper end position of the hook portion 102. This arrangement makes it possible to keep the lock member 103 in a range in which the lock member 103 does not interfere with the hook portion 102, i.e., on an outside of a moving range of the hook portion 102 moving along with the opening/closing motion of the front door 93, in the state in which the front door 93 is opened.

Second Embodiment

Next, a configuration of a lock unit 106 of a second embodiment will be described with reference to FIGS. 10A and 10B. The lock unit 106 of the present embodiment is different from that of the first embodiment in driving structure for moving a lock member 303. The configurations the lock unit 106 other than that are common with those of the first embodiment, so that the same components with those of the first embodiment will be denoted by the common reference numerals and their description will be omitted here.

Figure 10A:
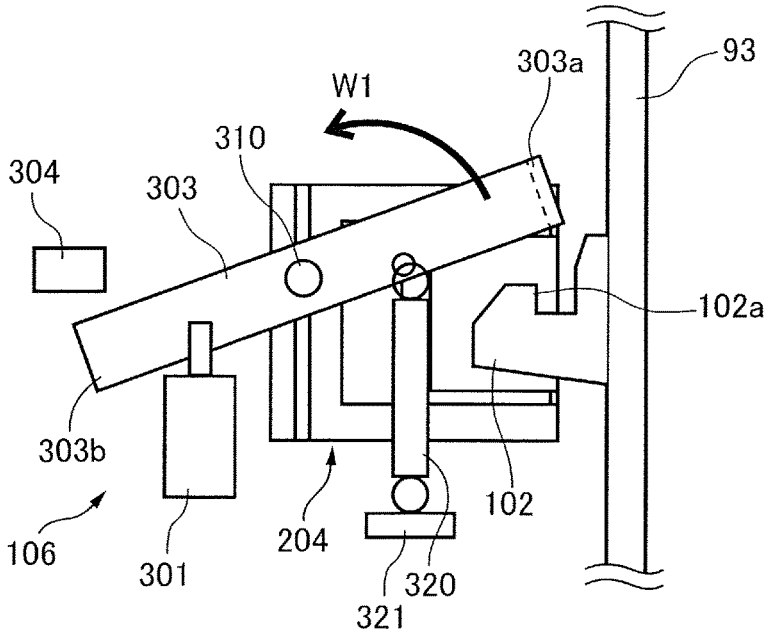
FIG. 10A is a schematic diagram of a lock unit of a second embodiment in a case where the lock member is located at the release position.
Figure 10B:
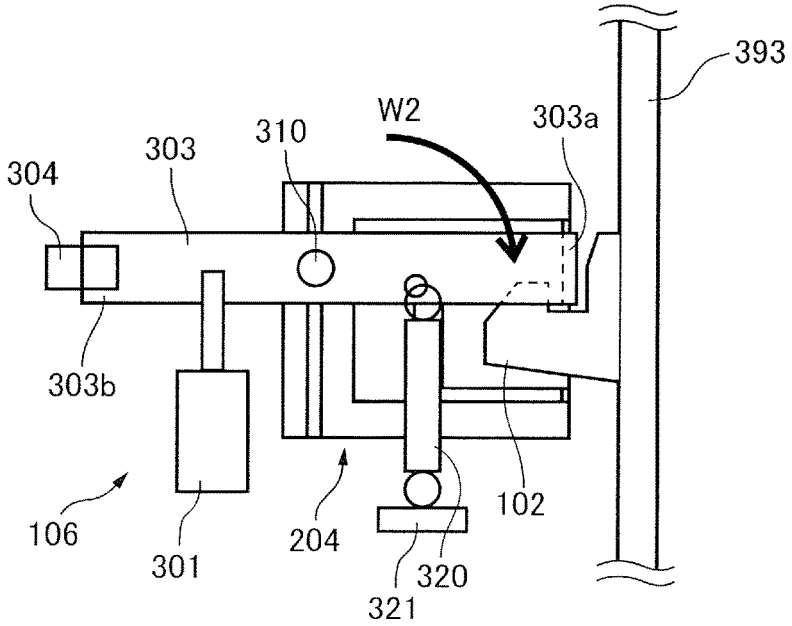
FIG. 10B is a schematic diagram of a lock unit of a second embodiment in a case where the lock member is located at the lock position.

As illustrated in FIG. 10A, the lock unit 106 includes the lock member 303, a lock detection sensor 304, a solenoid 301, a coil spring 320 and the opening/closing detection lever 204. The lock unit 106 also includes an opening/closing detection sensor and an urge portion. The lock member 303 serving as the lock portion includes a distal end portion 303*a* which is engageable with the locked portion 102*a* of the hook portion 102 and a detection target portion 303*b* to be detected by the lock detection sensor 304 and is swingable centering on a turning shaft 310.

The solenoid 301 and the coil spring 320 are connected with the lock member 303 on one side and another side with respect to the turning shaft 310. That is, the solenoid 301 is connected with the lock member 303 on the same side with the detected portion 303*b* and drives the lock member 303 in a direction W1 from the lock position to the release position when energized. Meanwhile, the coil spring 320 serving as an urging member is stretched between a fixed portion 321 fixed to the apparatus body 1A and the lock member 303, and urges the lock member 303 in a direction W2 from the release position to the lock position.

As described above, according to the present embodiment, a switching mechanism switching the lock member 303 between the release position and the lock position is composed of the solenoid 301 and the coil spring 320. Then, similarly to the first embodiment, the distal end portion 303*a* of the lock member 303 is disposed so as to be located above the first bent portion 251 of the opening/closing detection lever 204 (see FIG. 7) when the opening/closing detection lever 204 is located at the first position and the lock member 303 is located at the release position. This arrangement makes it possible to regulate the lock member 303 from moving toward the lock position in the state in which the front door 93 is opened and to prevent the apparatus from being damaged by the collision of the hook portion 102 with the lock member 303.

It is noted that similar advantages as the present embodiment will be brought about even by a configuration in which the lock member 303 is moved from one to the other of the release position and the lock position by a driving device such as a solenoid and in which the lock member 303 is urged in an opposite direction by an urging member such as a spring member.

OTHER EMBODIMENTS

While the front door 93 has been described above in the first and second embodiments, this technology is applicable also to an openable member openable/closable with respect to the apparatus body 1A. Besides a door member such as the front door 93 which is turnable in a horizontal direction, the openable member may be biparting members (hinged double doors), a sliding member, or a detachable member. An object to be locked by the lock portion is not also limited to be the door member or the cover member covering the internal structure of the apparatus body 1A, and it may be arranged such that the lock portion directly locks the sheet conveyance unit 1C, an image forming unit unitized into a cartridge, or the like. That is, the sheet conveyance unit 1C itself is one example of an openable member opened and closed with respect to the apparatus body 1A.

While the above embodiments have been described regarding the image forming apparatus 1, the technology of the present disclosure is applicable also to an apparatus that can be installed separately from the image forming apparatus, such as an option feeder and a sheet processing apparatus. Here, the option feeder refers to an apparatus added to the image forming apparatus and capable of feeding a sheet stored therein to the image forming apparatus. The sheet processing apparatus refers to an apparatus capable of receiving a sheet outputted from the image forming apparatus and performing a processing of the sheet such as stapling and folding. The technology of the present disclosure is applicable also to such apparatus, e.g., a sheet conveyance apparatus, as a configuration of a lock of a cover member covering a sheet conveyance path.

While the regulating portion 251*a* regulating the moving range of the lock member 103 has been disposed in one branched portion, i.e., the first branched portion 209, of the opening/closing detection lever 204 having the branched shape in the embodiments described above, the shape of the movable portion and the disposition of the regulating portion are not limited to those described above. For instance, it may be arranged such that one side of a flat detection lever functions as a regulating portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-137496, filed on Jul. 12, 2016, which is hereby incorporated by reference wherein in its entirety.

What is claimed is:

1. An image forming apparatus comprising:

an apparatus body including an image forming portion configured to form an image on a sheet;

an openable member having a hook portion and configured to be opened with respect to the apparatus body;

a lock portion disposed in the apparatus body and movable between a lock position to lock the openable member in a closed state and a release position to permit opening of the openable member; and a movable portion disposed in the apparatus body and configured to move with movement of the openable member such that the movable portion is located at a first position if the openable member is opened and at a second position if the openable member is closed, the movable portion including a block portion that is configured to block a movement of the lock portion from the release position to the lock position if the movable portion is located at the first position and that permits the lock portion to move from the release position to the lock position if the movable portion is located at the second position; and an urge portion configured to urge the movable portion to the first position, wherein the hook portion is configured to abut with and hold the movable portion at the second position in a state where the openable member is closed, and to be separated from the movable portion in a state where the openable member is open.

2. The image forming apparatus according to claim 1, wherein the lock portion comprises a swing member swingable about on a support shaft, and wherein the block portion is configured to abut with the lock portion at a position out of a moving range of the hook portion along with opening and closing of the openable member in terms of a circumferential direction of the support shaft.

3. The image forming apparatus according to claim 1, further comprising a cover member which is disposed in the apparatus body and in which the lock portion is stored, the cover member being provided with an opening portion through which the hook portion is inserted if the openable member is closed, wherein the movable portion comprises a plate member having an abutment surface abuttable with the hook portion and configured to cover the opening portion if the movable portion is located at the first position, and if the openable member is closed, the movable portion is moved to the second position by the hook portion pressing the abutment surface.

4. The image forming apparatus according to claim 1, further comprising a detection sensor configured to detect whether the openable member is opened or closed in response to movement of the movable portion between the first and second positions.

5. The image forming apparatus according to claim 4, wherein the detection sensor comprises a contact switch, wherein the movable portion includes an abutment portion configured to abut with the openable member, a detection portion configured to be in contact with the detection sensor, and a branched portion where the abutment portion and the detection portion branch from each other, and wherein the block portion is disposed in the abutment portion.

6. The image forming apparatus according to claim 5, wherein the movable portion is turnable with respect to the apparatus body.

7. The image forming apparatus according to claim 1, wherein the movable portion comprises a shaft portion supported by the apparatus body such that the movable portion is turnable with respect to the apparatus body and is restrained from moving along a rotation axis of the shaft portion, and wherein a moving direction of the lock portion upon moving from the release position to the lock position is a direction along the rotation axis of the shaft portion.

8. The image forming apparatus according to claim 1, further comprising a driving portion configured to move the lock portion from one of the lock position and the release position to the other of the lock position and the release position, wherein the lock portion remains at the one of the lock position and the release position by its own weight in a state in which the lock portion is not driven by the driving portion.

9. The image forming apparatus according to claim 1, further comprising:

a driving portion configured to move the lock portion from one of the lock position and the release position to the other of the lock position and the release position; and an urging member configured to urge the lock portion from the other to the one of the lock position and the release position.

10. The image forming apparatus according to claim 1, further comprising a conveyance unit drawably attached to the apparatus body and configured to convey a sheet, wherein the openable member is a cover member covering the conveyance unit.

11. A sheet conveyance apparatus comprising:

an apparatus body;

a conveyance unit supported by the apparatus body and configured to convey a sheet;

an openable member including a hook portion and configured to be opened with respect to the apparatus body;

a lock portion disposed in the apparatus body and movable between a lock position to lock the openable member in a closed state and a release position to permit opening of the openable member; and a movable portion disposed in the apparatus body and configured to move with movement of the openable member such that the movable portion is located at a first position if the openable member is opened and at a second position if the openable member is closed, the movable portion including a block portion that is configured to block a movement of the lock portion from the release position to the lock position if the movable portion is located at the first position and that permits the lock portion to move from the release position to the lock position if the movable portion is located at the second position; and an urge portion configured to urge the movable portion to the first position, wherein the hook portion is configured to abut with and hold the movable portion at the second position in a state where the openable member is closed, and to be separated from the movable portion in a state where the openable member is open.

12. An image forming apparatus comprising:

an apparatus body comprising an image forming portion configured to form an image on a sheet;

an openable member configured to be opened with respect to the apparatus body;

a lock portion disposed in the apparatus body and movable between a lock position to lock the openable member in a closed state and a release position to permit opening of the openable member;

a movable portion disposed in the apparatus body and configured to move with movement of the openable member such that the movable portion is located at a first position if the openable member is opened and at a second position if the openable member is closed, the movable portion including a block portion that is configured to block a movement of the lock portion from the release position to the lock position if the movable portion is located at the first position and that permits the lock portion to move from the release position to the lock position if the movable portion is located at the second position; and a driving portion configured to move the lock portion from one of the lock position and the release position to the other of the lock position and the release position, wherein the lock portion remains at the one of the lock position and the release position by its own weight in a state in which the lock portion is not driven by the driving portion.

* * * * *